US008833427B2

(12) United States Patent
Kazuma

(10) Patent No.: US 8,833,427 B2
(45) Date of Patent: Sep. 16, 2014

(54) PANEL-TYPE CURTAIN AND COUPLING METHOD OF THE SAME

(75) Inventor: Kuniharu Kazuma, Fukui (JP)

(73) Assignee: Kazuma Co., Ltd., Fukui (JP)

( * ) Notice: Subject to any disclaimer, the term of this patent is extended or adjusted under 35 U.S.C. 154(b) by 0 days.

(21) Appl. No.: 13/824,636

(22) PCT Filed: Jun. 10, 2011

(86) PCT No.: PCT/JP2011/003323

§ 371 (c)(1),
(2), (4) Date: Mar. 18, 2013

(87) PCT Pub. No.: WO2012/168987

PCT Pub. Date: Dec. 13, 2012

(65) Prior Publication Data

US 2013/0186579 A1 Jul. 25, 2013

(51) Int. Cl.

| | |
|---|---|
| ***E05D 15/06*** | (2006.01) |
| ***A47H 15/04*** | (2006.01) |
| ***A47H 13/04*** | (2006.01) |
| ***A47H 1/00*** | (2006.01) |
| *A47H 23/02* | (2006.01) |
| *A47H 1/04* | (2006.01) |

(52) U.S. Cl.

CPC ..... *A47H 15/04* (2013.01); *A47H 2023/025* (2013.01); *A47H 2001/047* (2013.01); *A47H 13/04* (2013.01); *A47H 1/00* (2013.01)

USPC ..... 160/197; 160/202

(58) Field of Classification Search

USPC ..... 160/202, 222, 196.1, 197, 126, 345, 160/330, 341; 16/90, 93 R, 93 D, 94 R, 94 D, 16/96, 96 D, 95 R, 95 D

See application file for complete search history.

(56) References Cited

U.S. PATENT DOCUMENTS 3,642,051 A * 2/1972 Goldner ..... 160/197
3,911,991 A * 10/1975 Malferrari ..... 160/202

(Continued)

FOREIGN PATENT DOCUMENTS

JP H01-007831 Y 3/1989
JP 2005-040226 A 2/2005

(Continued)

OTHER PUBLICATIONS

International Search Report and Written Opinion of the International Searching Authority mailed Jul. 12, 2011 for the corresponding international application No. PCT/JP2011/003323.

(Continued)

*Primary Examiner* — Katherine Mitchell
*Assistant Examiner* — Johnnie A Shablack
(74) *Attorney, Agent, or Firm* — Muncy, Geissler, Olds & Lowe, P.C.

(57) ABSTRACT

A panel-type curtain that can be attached easily to a curtain rail even after attachment of a curtain member, and that can allow the curtain member to slide smoothly. Specifically, a panel-type curtain is hung on runners of a curtain rail via supports, the panel-type curtain including an elongated holding frame capable of catching the supports, and curtain members supported by the holding frame, wherein the holding frame has a first coupling bar having a rail portion on a front side thereof, and a second coupling bar having a projecting slider slidably fitted in the rail portion of the first coupling bar on a back side thereof, and the slider and the rail portion constitute a bayonet structure.

9 Claims, 8 Drawing Sheets

(56) References Cited

U.S. PATENT DOCUMENTS

| | | | | |
|---|---|---|---|---|
| 4,635,699 | A * | 1/1987 | Kauffman et al. | 160/211 |
| 4,858,668 | A * | 8/1989 | Toti | 160/84.04 |
| 5,109,913 | A * | 5/1992 | Kazuma | 160/332 |
| 5,259,520 | A * | 11/1993 | Roggio et al. | 211/105.1 |
| 5,272,839 | A * | 12/1993 | Karhu | 49/409 |
| 6,336,247 | B1 * | 1/2002 | Schnoor | 16/87.6 R |
| 6,860,064 | B2 * | 3/2005 | Bakalar | 49/127 |
| 6,892,783 | B1 * | 5/2005 | Comeau et al. | 160/126 |
| 6,923,238 | B2 * | 8/2005 | Kern et al. | 160/197 |
| 7,174,944 | B1 * | 2/2007 | Clark et al. | 160/197 |
| 7,260,916 | B2 * | 8/2007 | Sarnell et al. | 49/409 |
| 7,270,165 | B1 * | 9/2007 | Chuang | 160/197 |
| 7,299,852 | B1 * | 11/2007 | Chuang | 160/197 |
| 7,424,935 | B1 * | 9/2008 | Smith | 187/333 |
| 7,762,305 | B2 * | 7/2010 | Huang | 160/201 |
| 8,176,964 | B2 * | 5/2012 | Janach | 160/197 |
| 8,297,334 | B2 * | 10/2012 | Chu | 160/222 |
| 8,579,006 | B2 * | 11/2013 | Levin | 160/184 |
| 2007/0158036 | A1 * | 7/2007 | Lin | 160/197 |

FOREIGN PATENT DOCUMENTS

| | | | |
|---|---|---|---|
| JP | 2006-507064 | A | 3/2006 |
| JP | 2006-280851 | A | 10/2006 |
| JP | 2007-105234 | A | 4/2007 |
| JP | 2007-138601 | A | 6/2007 |
| JP | 2007-244661 | A | 9/2007 |

OTHER PUBLICATIONS

Notice of Allowance mailed Jan. 30, 2012 issued in corresponding JP application No. 2011-550378 (English Translation attached).

Supplementary European Search Report of EP11813644 mailed Jun. 2, 2014.

* cited by examiner

PANEL-TYPE CURTAIN AND COUPLING METHOD OF THE SAME

CROSS REFERENCE TO RELATED APPLICATIONS

The present application is a U.S. national stage of PCT/JP2011/003323 filed on Jun. 10, 2011, whose Japanese national stage application is Japanese Patent Application No. 2011-550378 filed on Jun. 10, 2011, allowed on Jan. 31, 2012 and issued on Feb. 17, 2012 as Japanese Patent No. 4928015, the disclosure of which is incorporated herein by reference.

TECHNICAL FIELD

The present invention relates to a panel-type curtain, and more specifically to a panel-type curtain useable with at least one curtain rail, providing easy coupling of curtain holding members, having an uncomplicated structure, and also slidable smoothly, and a coupling method of the same.

BACKGROUND ART

Currently, a panel-type curtain is widely used for screening a room, or partition, separation, or the like of a room.

Generally, this panel-type curtain is such that a panel-type curtain member (generally, a fabric, such as a knit fabric or a woven fabric) is hung on a curtain rail, and a plurality of the panel-type curtain members are aligned with each other.

For example, as an example of using two curtain rails, a panel screen (for example, see Patent Document 1) where two guide rails (curtain rails) are arranged in parallel, runners are provided in the vicinity of both right and left upper ends of each screen gray fabric, and the left runner freely runs on the first guide rail while the right runner freely runs on the second guide rail, a curtain apparatus (for example, see Patent Document 2) including a slat on which a panel or a curtain gray fabric is hung so as to move freely, with both end portions of the slat guided in a first common track and a second common track, respectively, a screening apparatus (for example, see Patent Document 3) where first and second curtain rails are arranged in parallel at a predetermined distance from each other, first and second runners are provided on an upper edge of a panel screen, and the first runner is provided so as to be capable of running on the first curtain rail while the second runner is provided so as to be capable of running on the second curtain rail, or the like are known.

However, since these curtains require two guide rails, they cannot be installed when there is only one curtain rail.

Further, even if there are two curtain rails, the curtain member installed is directed largely obliquely, which causes an increase in thickness and such a disadvantage that screening of a room or partition, separation, or the like of a room cannot sufficiently be achieved.

Further, since there are two guide rails, there is a limit to a distance between the two guide rails that can be reduced.

Besides these, a panel curtain (for example, see Patent Document 4) where a rail for a panel curtain where a plurality of rail portions on which panels can be attached are arranged in their front-back direction and supporting portions provided on both ends of each rail portion are provided with projections capable of being inserted and fitted in curtain runners, a panel curtain (for example, see Patent Document 5) where a flat plate-shaped panels are supported so as to move freely along a plurality of hanger rails, a hanging frame which hangs and supports the panel from the hanger rail are divided into a pivotal hanging frame and a non-pivotal hanging frame, and the pivotal hanging frame is supported on the non-pivotal hanging frame so as to be capable of pivoting on a hinge like a cantilever, a panel curtain (for example, see Patent Document 6) where a plurality of planar panels are hung and supported so as to be capable of moving along a hanger rail at certain intervals in their front-back direction, or the like are known.

On the other hand, a panel-type curtain using a single curtain rail has also been developed.

For example, there is a vertical curtain (for example, see Patent Document 7) where curtain-supporting sheets are attached to sliding portions provided so as to move freely on a curtain rail such that they overlap with one another at different positions, and a plurality of vertical leaves fixed to the curtain-supporting sheets which are curtain-holding members move so as to overlap with each other.

PRIOR ART DOCUMENTS

Patent Documents

[Patent Document 1] JUMB-H01-7830
[Patent Document 2] National Publication of International Patent Application No. 2006-507064
[Patent Document 3] JPA-2007-138601
[Patent Document 4] JPA-2005-40226
[Patent Document 5] JPA-2007-105234
[Patent Document 6] JPA-2007-244661
[Patent Document 7] JPA-2006-280851

SUMMARY OF THE INVENTION

Problems to be Solved by the Invention

However, this vertical curtain has a complicated structure, and it is not easy to couple the curtain-holding members.

Further, the thickness of the curtain-holding member increases and therefore it is not compact.

The curtain member cannot necessarily be smoothly slid, either.

Furthermore, it is extremely difficult to attach the curtain holding member to the curtain rail in a state where a curtain-holding member has been attached to the curtain holding member.

The present invention has been made in view of these circumstances, and an object of the present invention is to provide a panel-type curtain usable with at least one curtain rail, providing easy coupling of coupling bars which are curtain-holding members, having an uncomplicated structure, and also slidable smoothly.

Means for Solving the Problems

The present inventor has made intensive studies to solve the problems described above, has found that the problems described above can be solved by employing a bayonet structure to couple a rail portion of a first coupling bar with a slider of a second coupling bar, and has reached completion of the present invention.

The present invention lies in (1) a panel-type curtain hung on runners of a curtain rail via supports, the panel-type curtain including an elongated holding frame capable of catching the supports and curtain members supported by the holding frame, wherein the holding frame has a first coupling bar having a rail portion on a surface side and a second coupling bar having a projecting slider slidably fitted in the rail portion of the first coupling bar on a back side, and the slider and the rail portion constitute a bayonet structure.

The present invention lies in (2) the panel-type curtain according to the above aspect (1), wherein both upper end portions and lower end portions of the first coupling bar and the second coupling bar are provided with holes capable of catching the supports.

The present invention lies in (3) the panel-type curtain according to the above aspect (1) or (2), wherein the second coupling bar has a rail portion on a front side.

The present invention lies in (4) the panel-type curtain according to any one of the above aspects (1) to (3), wherein touch fasteners are attached to a back side of the first coupling bar and a back side of the second coupling bar.

The present invention lies in (5) the panel-type curtain according to any one of the above aspects (1) to (4), wherein the supports have S-shaped profiles, and are provided with stoppers from curved portions to distal ends.

The present invention lies in (6) the panel-type curtain according to any one of the above aspects (1) to (5), wherein the slider is fixed to a lateral end portion of the second coupling bar.

The present invention lies in (7) the panel-type curtain according to any one of the above aspects (1) to (5), wherein the slider includes a base portion, a neck portion provided to the base portion, and a head portion coupled with the neck portion, the base portion can be fixed to the lateral end portion of the second coupling bar, and the neck portion and the head portion form a T-shaped profile.

The present invention lies in (8) a coupling method of the panel-type curtain described in the above aspect (1), wherein the second coupling bar is slidably coupled with the first coupling bar by placing the second coupling bar at an angle of 90 degrees to the first coupling bar, then pushing the slider of the second coupling bar into the rail portion of the first coupling bar, and then turning the second coupling bar by 90 degrees.

It should be noted that it is also possible to employ a configuration including any combination of the inventions described above, as long as it meets the object of the present invention.

Effects of the Invention

The panel-type curtain of the present invention can be used with at least one curtain rail.

This reduces the thickness and makes it considerably compact.

Since the rail portion of the first coupling bar and the slider of the second coupling bar constitute a bayonet structure, the coupling bars can be coupled to each other extremely easily by the simple operations "pushing-in" and "turning".

Besides, the structure is uncomplicated and sliding can also be performed smoothly.

Even in a state where the curtain members have been attached to the first coupling bar and the second coupling bar, the second coupling bar can be attached easily to the first coupling bar.

In the panel-type curtain of the present invention, in the case where both upper end portions and lower end portions of the first coupling bar and the second coupling bar are provided with holes capable of catching the supports, the holding frame can also be used upside down.

In the case of using the holding frame upside down, one side attached with the curtain member and the other side having the rail portion are inverted to each other.

In the panel-type curtain of the present invention, in the case where the second coupling bar has a rail portion on a front side, three curtain members can be aligned with one another by fitting a slider of another coupling bar into the rail portion of the second coupling bar.

Further, these curtain members can be slid smoothly on one another.

Thus, more curtain members can be arranged.

In the panel-type curtain of the present invention, in the case where touch fasteners are attached to a back side of the first coupling bar and a back side of the second coupling bar, it becomes possible to readily attach the curtain members instantly by only pushing the curtain members onto the touch fasteners simply.

In the panel-type curtain of the present invention, in the case where the supports have S-shaped profiles, and are provided with stoppers from curved portions to distal ends, there is the advantage that the panel-type curtain is easy to attach and unlikely to drop off.

In the panel-type curtain of the present invention, in the case where the slider is fixed to a lateral end portion of the second coupling bar, the second coupling bar can be widely and securely slid.

Further, in the case where the slider has a base portion, the slider can be easily fixed by fitting the base portion into the lateral end portion of the second coupling bar.

Furthermore, since the neck portion and the head portion of the slider form a T-shaped profile, the slider can easily be fitted loosely in the rail portion.

BRIEF DESCRIPTION OF THE DRAWINGS

In FIG. 2(*a*), a middle section is illustrated, which is an opening and defined with two blocking members 6 attached to the lateral end portions of first coupling bar 2*a*. In FIG. 2(*c*), references 2*h* and 2*q* are added. 2*h* is for a hollow space of the rail portion 3*a*. 2*a* is for an opening defined with hanging portion P1 and rising portion P2.

In FIG. 3(*a*), another middle section is illustrated, which is an opening and defined with blocking member 16 and slider 20 attached to the lateral end portions of second coupling bar 2*b*.

BEST MODE FOR CARRYING OUT THE INVENTION

Figure 1:
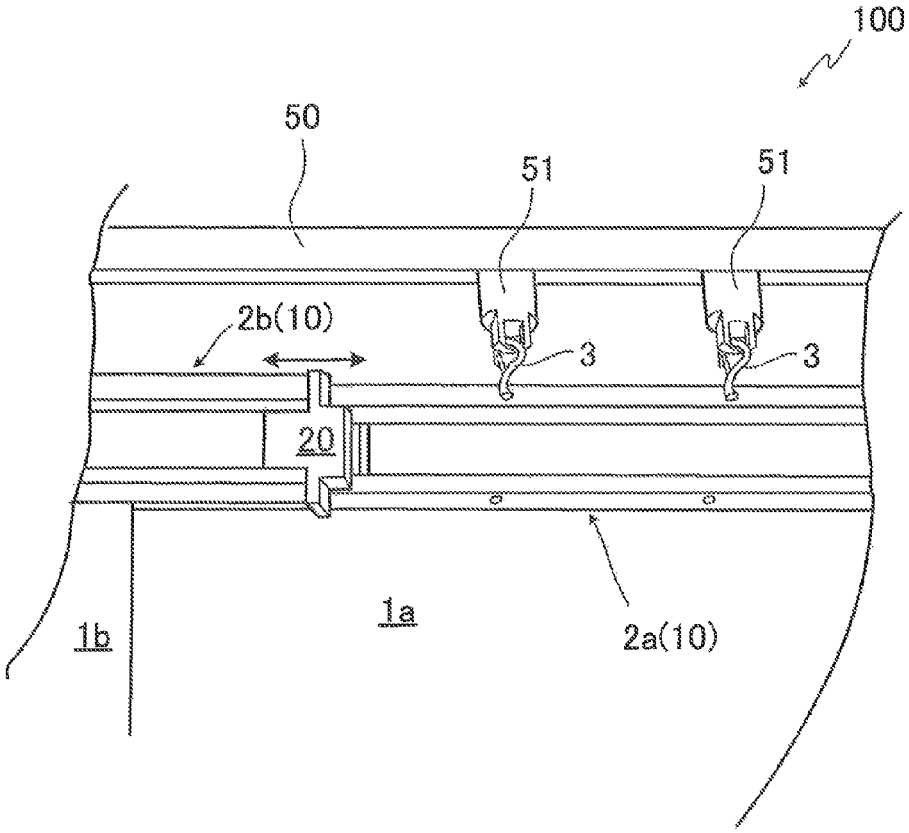
FIG. 1 is a partial perspective view showing an example of a panel-type curtain according to an embodiment of the present invention.

Hereinafter, with reference to the figures as necessary, a preferred embodiment of the present invention will be described.

It should be noted that identical elements are marked with identical reference numerals so that redundant description will be left out.

It should also be noted that positional relationships, such as top, bottom, right and left, are based on positional relationships shown in the figures, unless otherwise noted.

Furthermore, it should be noted that the dimensional ratio of each figure is not limited to the ratio shown.

FIG. 1 is a partial perspective view showing an example of a panel-type curtain according to the embodiment.

As shown in FIG. 1, a panel-type curtain 100 according to the embodiment can be hung on runners 51 of a conventional curtain rail 50 via supports 3.

The panel-type curtain 100 includes elongated holding frames 10 capable of catching the supports 3, and curtain members 1*a* and 1*b* supported by the holding frames 10.

Further, the holding frames 10 include a first coupling bar 2*a*, and a second coupling bar 2*b* slidable relative to the first coupling bar 2*a* in a longitudinal direction thereof.

That is, in the panel-type curtain described above, in a state where the curtain member (referred to as a "first curtain member" below for convenience) 1*a* has been supported by the first coupling bar 2*a* and the curtain member (referred to as a "second curtain member" below for convenience) 1*b* has been supported by the second coupling bar 2*b*, the first curtain member 1*a* and the second curtain member 1*b* are slidable relative to each other.

Here, the coupling bar and the curtain member are fixed to each other by a touch fastener described later and the fixed state is maintained.

Figure 2A:
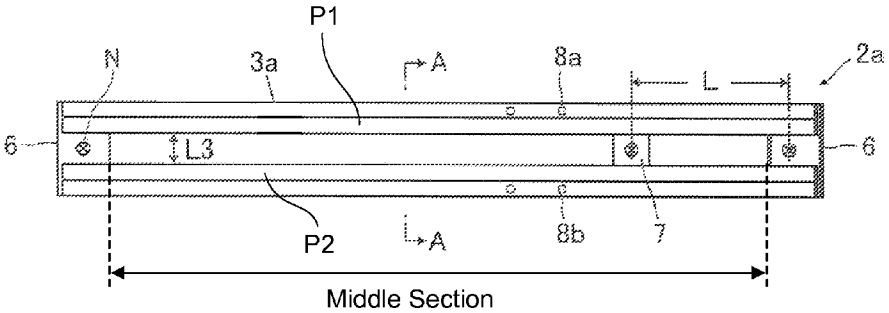
FIG. 2(*a*) is a surface side view showing a first coupling bar of the panel-type curtain according to the embodiment, FIG. 2(*b*) is a back side view thereof, and FIG. 2(*c*) is a sectional view thereof taken along line A-A in FIG. 2(*a*).
Figure 2B:
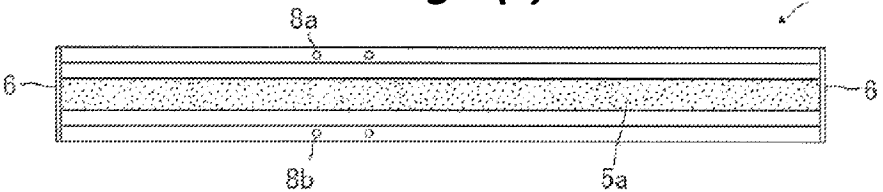
Figure 2C:
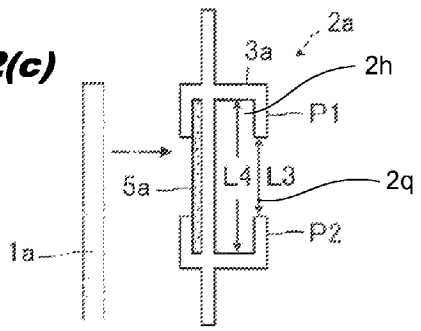

FIG. 2(*a*) is a surface side view showing the first coupling bar of the panel-type curtain according to the embodiment, FIG. 2(*b*) is a back side view thereof, and FIG. 2(*c*) is a sectional view thereof taken along line A-A in the FIG. 2(*a*).

As shown in FIGS. 2(*a*) and 2(*c*), the first coupling bar 2*a* has a rail portion (referred to as a "first rail portion" below for convenience) 3*a* on a surface side, and, as shown in FIG. 2(*b*), has a touch fastener (referred to as a "first touch fastener" below for convenience) 5*a* attached thereto on a back side.

Since the first coupling bar 2*a* has the first rail portion 3*a* on the surface, by fitting a slider 20 of the second coupling bar 2*b* described later into the first rail portion 3*a*, the second coupling bar 2*b* is made slidable relative to the first coupling bar 2*a* linearly.

Further, since the first touch fastener 5*a* is attached to the back side, the curtain member 1*a* can easily be attached to the first touch fastener 5*a* by simply pushing the curtain member 1*a* thereto in a direction of arrow, as shown in FIG. 2(*c*).

Incidentally, the curtain member 1*a* also has a touch fastener which makes fixation to the first touch fastener 5*a* possible.

Blocking members 6 are fitted on and fixed to both ends of the first coupling bar 2*a* so that the slider 20 (see FIG. 1) of the second coupling bar 2*b* is prevented from separating from the first rail portion 3*a* by the blocking members 6.

Further, the first coupling bar 2*a* is provided with a positioning member 7 which can be fixed by a screw or the like to the first rail portion 3*a*, so that the slider which slides rightward and leftward can be stopped at a desired position.

That is, by adjusting a distance L from the blocking member 6 to the positioning member 7, the range of movement of the slider can be adjusted.

The first coupling bar 2*a* is provided with holes 8*a* capable of catching the supports 3 (not shown) at an upper end portion thereof.

Therefore, by hooking one ends of the supports 3 into the holes 8*a* of the first coupling bar 2*a*, and attaching the other ends of the supports 3 to runners 51 of the curtain rail 50, the first coupling bar 2*a* is hung on the curtain rail 50.

The first coupling bar 2*a* is also provided with holes 8*b* capable of catching the support 3 (not shown) at a lower end portion thereof.

This makes it possible to use the first coupling bar 2*a* (holding frame 10) upside down.

That is, the supports 3 can be attached to the upper end portion of the first coupling bar 2*a*, and the supports 3 can also be attached to the lower end portion thereof.

Figure 3A:
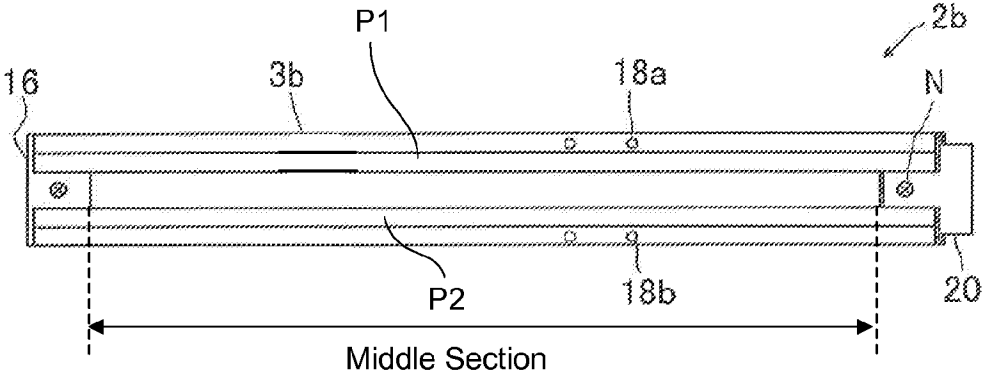
FIG. 3(*a*) is a surface side view showing a second coupling bar of the panel-type curtain according to the embodiment, and FIG. 3(*b*) is a back side view thereof.
Figure 3B:
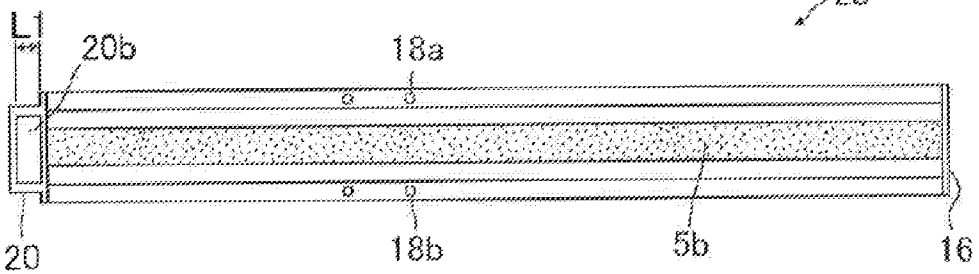

FIG. 3(*a*) is a surface side view showing the second coupling bar of the panel-type curtain according to the embodiment, and FIG. 3(*b*) is a back side view thereof.

As shown in FIG. 3(*a*), the second coupling bar 2*b* has a rail portion (referred to as a "second rail portion" below for convenience) 3*b* on a surface side, and, as shown in FIG. 3(*b*), has a touch fastener (referred to as a "second touch fastener" below for convenience) 5*b* attached thereto on a back side.

Since the second coupling bar 2.*b* has the second rail portion 3*b* on the surface side, for example, by preparing a coupling bar (referred to as a "third coupling bar" below for convenience) having the same shape as the second coupling bar 2*b*, and fitting a slider of this not-shown third coupling bar into the second rail portion 3*b* of the second coupling bar 2*b*, three curtain members can be aligned with one another, and they can be slid relative to one another smoothly.

Incidentally, by further preparing another coupling bar having the same shape, and similarly fitting the same into the third coupling bar, four curtain members can be aligned with one another, and by further repeating this operation, a desired number of curtain members can be disposed.

Obviously, each of these coupling bars is hung on the runners 51 of the curtain rail 50.

Further, since the second touch fastener 5*b* is attached to the second coupling bar 2*b* on the back side, the second curtain member 1*b* can be easily attached to the second coupling bar 2*b* instantly by utilizing the second touch faster 5*b*.

As described above, by using one curtain rail, a lot of curtain members can be disposed.

Since only one curtain rail is used, even a lot of curtain members do not cause an increase in thickness and keep the panel-type curtain compact, unlike the conventional panel-type curtains.

The second coupling bar 2*b* has the slider 20 (specifically, a thin portion 20*c*2 of the slider) fitted on one lateral end, and a blocking member 16 fitted on the other lateral end, and each of the slider 20 and the blocking member 16 is fixed by a screw N or the like.

Incidentally, since the slider 20 also serves as a blocking member, when the third coupling bar is attached to the second coupling bar 2*b*, a slider thereof is prevented from separating from the second rail portion 3*b*.

Figure 4A:
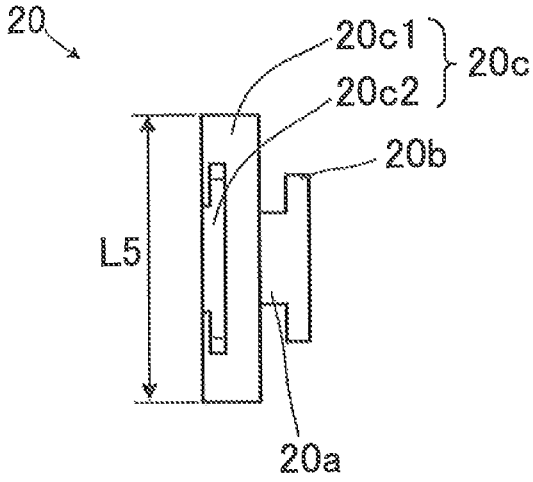
FIG. 4(*a*) is a top view showing a slider used in the panel-type curtain according to the embodiment, and FIG. 4(*b*) is a right side view of the slider in FIG. 4(*a*).
Figure 4B:
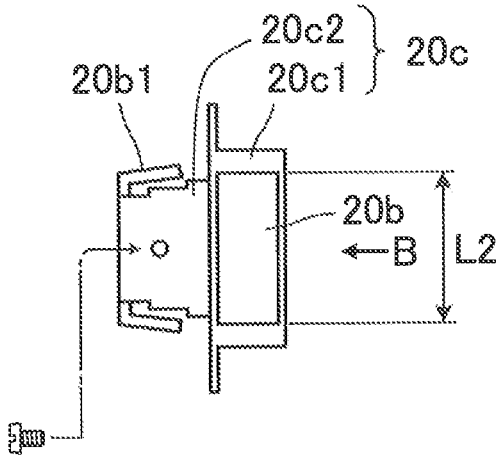

FIG. 4(*a*) is a top view showing the slider used in the panel-type curtain according to the embodiment, and FIG. 4(*b*) is a right side view of the slider shown in FIG. 4(*a*).

As shown in FIGS. 4(*a*) and 4(*b*), the slider 20 includes a base portion 20*c* (which includes a base 20*c*1 and a thin portion 20*c*2 extended at aright angle from a side face of the base 20*c*1), a neck portion 20*a* made erect from a side face of the base portion 20*c* to be thinner than the base portion 20*c*, and a head portion 20*b* expanded to be thicker than the neck portion 20*a*.

Thus, the neck portion 20*a* and the head portion 20*b* form a T-shaped profile, as viewed from their sides.

Therefore, a space corresponding to the length of the neck portion 20*a* occurs between the base portion 20*c* and the head portion 20*b*.

The slider 20 can be fixed by fitting the base portion 20*c*, specifically, a portion of the base portion 20*c*, on the lateral end portion of the second coupling bar 2*b* (see FIG. 3).

That is, the thin portion 20*c*2 is fitted in a space inside the first rail portion 3*a*.

At this time, since elastic pieces 20*b*1 provided to both side faces of the thin portion 20*c*2 press inner wall faces of the first rail portion 3*a*, fitting can be easily, achieved.

Thus, the slider 20 can easily be fixed to the second coupling bar 2*b*.

Incidentally; though described above, the slider 20 is more securely fixed by a screw or the like.

Further, since the neck portion 20*a* and the head portion 20*b* form the T-shaped profile, as viewed from their sides, the slider 20 can be loosely fitted in the first rail portion 3*a* easily by nipping the neck portion 20*a*.

Like the first coupling bar 2*a*, the second coupling bar 2*b* is provided with holes 18*a* capable of catching the supports 3 (not shown) at an upper end portion thereof. Therefore, by hooking one ends of the supports 3 into the holes 18*a* of the second coupling bar 2*b*, and attaching the other ends to the runners of the curtain rail 50, the second coupling bar 2*b* is hung on the curtain rail 50.

Like the first coupling bar 2*a*, the second coupling bar 2*b* is also provided with holes 18*b* capable of catching the supports 3 (not shown) at a lower end portion thereof.

This makes it possible to use the second coupling bar 2*b* (holding frame 10) upside down.

That is, the supports 3 can be attached to the upper end portion, and the supports 3 can also be attached to the lower end portion.

Figure 5:
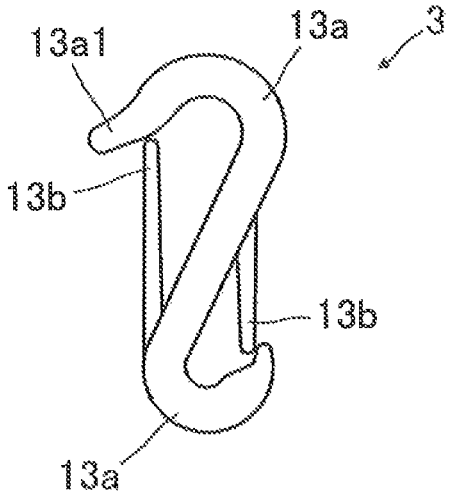
FIG. 5 is a side view showing a support attached to the panel-type curtain according to the embodiment.

FIG. 5 is a side view showing the support attached to the panel-type curtain according to the embodiment.

As shown in FIG. 5, this support 3 has an S-shaped profile, as view from a side face thereof, and is provided with stoppers 13*b* extending from curved portions 13*a* to distal ends.

This provides the advantage that the support 3 is easy to attach and unlikely to drop off.

Incidentally, a curvature of the curved portion caught on the curtain-rail side is large while a curvature of the curved portion caught on the curtain-member side is small.

The distal end of the curved portion on the curtain-rail side extends outward linearly so that an extended portion 13*a*1 is formed. Since the support 3 is provided with this extended portion 13*a*1, there is such an advantage that a user can easily hook the support 3 on the runner 51 of the curtain rail 50 with his/her fingers.

In the panel-type curtain 100 according to the embodiment, by inserting one ends (curved portions) of the supports 3 into the holes 8*a* of the first coupling bar 2*a* and inserting the other ends into the runners 51 of the curtain rail 50, thereby hooking the supports 3, the first coupling bar 2*a* is hung on the runners 51 of the curtain rail 50 via the supports 3.

Similarly, by inserting one ends of the supports 3 into the holes 18*a* of the second coupling bar 2*b* and inserting the other ends into the runners 51 of the curtain rail 50, thereby hooking other supports 3, the second coupling bar 2*b* is hung on the runners 51 of the curtain rail 50 via the supports 3.

At this time, as described above, since the support 3 is provided with the stoppers 13*b*, the support 3 is prevented from accidentally dropping off of the runners 51 and the holes 8*a*, 18*a*.

Next, a method of fitting the second coupling bar 2*b* into the first coupling bar 2*a* to coupling them to each other in the panel-type curtain 100 according to the embodiment will be described.

Incidentally, though only the coupling bars are shown here, the same fitting operation is applied to the coupling bars with the curtain members attached thereto.

Figure 6A:
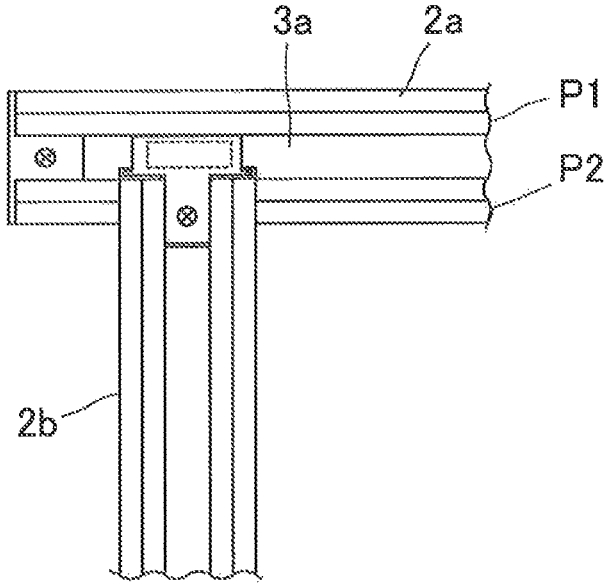
FIGS. 6(*a*) to 6(*c*) are illustrative views showing a method of coupling the second coupling bar with the first coupling bar in the panel-type curtain according to the embodiment.
Figure 6B:
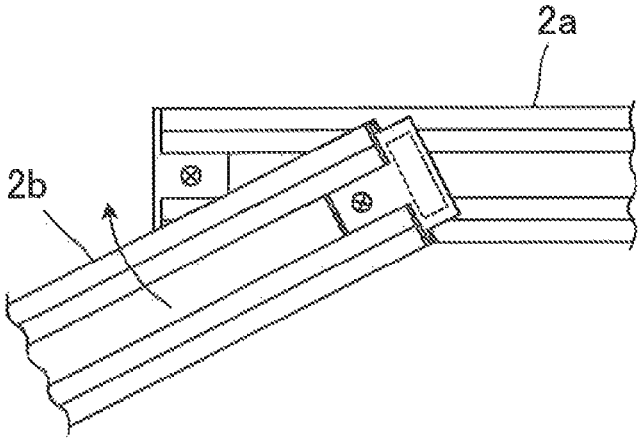
Figure 6C:
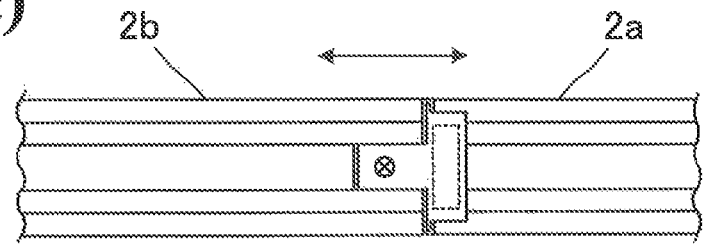

FIGS. 6(*a*) to 6(*c*) are illustrative views for illustrating the operation of fitting the second coupling bar into the first coupling bar in the panel-type curtain according to the embodiment.

Figure 7A:
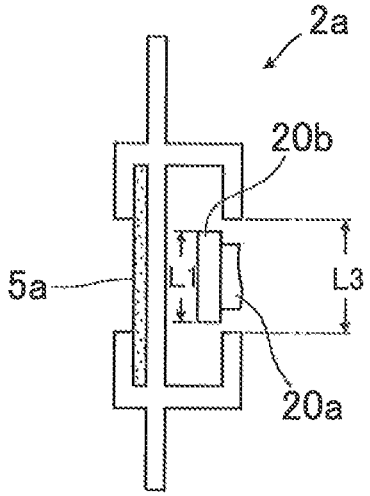
FIG. 7(*a*) is a schematic view showing a state where the slider has been pushed in a first rail in the panel-type curtain according to the embodiment, and FIG. 7(*b*) is a schematic view showing a state where the slider has been pushed in the first rail and has been turned in the panel-type curtain.
Figure 7B:
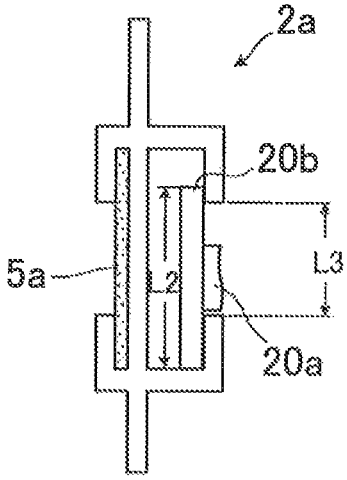

FIG. 7(*a*) is a schematic view showing a state where the slider has been pushed in the first rail in the panel-type curtain according to the embodiment, and FIG. 7(*b*) is a schematic view showing a state where the slider has been pushed in the first rail and has been turned.

First, as shown in FIG. 6(*a*), the second coupling bar 2*b* is placed at an angle of 90 degrees to the first coupling bar 2*a*.

At this time, the direction of a long side of the head portion 20*b* of the slider is opposed to a hanging portion P1 and a rising portion P2 along a space between the hanging portion P1 and the rising portion P2.

Incidentally, the first coupling bar 2*a* is hung on the runners 51 of the curtain rail 50 via the supports 3.

Next, in this state, the head portion 20*b* of the slider 20 is pushed into a space of the first rail portion 3*a* (pushing-in step).

Here, a relationship among a length L1 of a short side of the head portion 20*b* of the slider 20, a length L2 of the long side of the head portion 20*b*, a length L5 of the base portion 20*c*, a distance L 3 between the hanging portion P1 and the rising portion P2 of the first rail portion 3*a* in the first coupling bar 2*a*, and a distance L4 of an internal space of the first rail portion 3*a* in the first coupling bar 2*a* that is, a distance between an upper wall and a lower wall that form the space) is as follows:

$$L1<L3<L2<L4$$

$$L3<L5.$$

Thus, since the length L1 of the short side of the head portion 20*b* is shorter than the distance L3 of the internal space of the first rail portion 3*a*, the slider 20 can easily be pushed and fitted into the first rail portion 3*a*, as shown in FIG. 7(*a*).

Then, as shown in FIGS. 6(*b*) and 6(*c*), the second coupling bar 2*b* is turned by 90 degrees to the first coupling bar 2*a* so that the first coupling bar 2*a* and the second coupling bar 2*b* are aligned with each other (turning step).

As shown in FIG. 7(*b*), since the length L2 of the long side of the head portion 20*b* is shorter than the distance L4 of the internal space of the first rail portion 3*a*, the turning can easily be made.

Now the second coupling bar 2*b* is slidably coupled with the first coupling bar 2*a*.

Since the length L2 of the long side of the head portion 20*b* is longer than the distance L3 between the hanging portion P1 and the rising portion P2 of the first rail portion 3*a*, the slider 20 is prevented from separating from the first rail portion 3*a* when the slider 20 is slid.

Thus, the panel-type curtain according to the embodiment has the extremely convenient bayonet structure where coupling the slider 20 and the first rail portion 3*a* are coupled to each other according to the easy operations of "pushing-in" and "turning".

This makes it possible to easily attach the second coupling bar 2*b* to the first coupling bar 2*a* even in a state where the first curtain member 1*a* has been attached to the first coupling bar 2*a* and the second curtain member 1*b* has been attached to the second coupling bar 2*b*.

In particular, after the first coupling bar 2*a* with the first curtain member 1*a* attached thereto is attached to the curtain rail 50, the second coupling bar 2*b* with the curtain member 1*b* attached thereto can easily be attached to the first coupling bar 2*a*.

The reason is that the slider 20 of the second coupling bar 2*b* can easily be fitted into the first rail portion 3*a* of the first coupling bar 2*b* by the operations of the "pushing-in" and "turning".

Thus, in the panel-type curtain 100 described above, there is such an advantage that the coupling bars can easily be attached to the curtain rail 50 even after the curtain members 1*a*, 1*b* are attached thereto.

Further, in the panel-type curtain 100 described above, since its structure is simple, it becomes possible to slide the second coupling bar 2*b* relative to the first coupling bar 2*a* smoothly.

It should be noted that, preferably, the slider slides while a lower end face of the head portion 20*b* comes in contact with a lower wall of the first coupling bar 2*a*, thereby providing smooth movement.

Figure 8A:
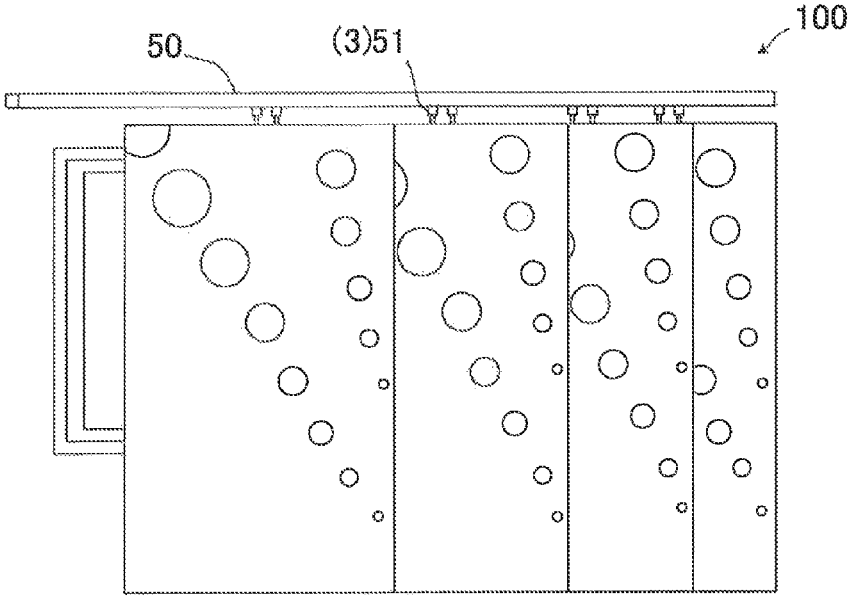
FIG. 8 (*a*) is a view showing the panel-type curtain according to the embodiment in an opened state, and FIG. 8(*b*) is a view showing the panel-type curtain according to the embodiment in a closed state.
Figure 8B:
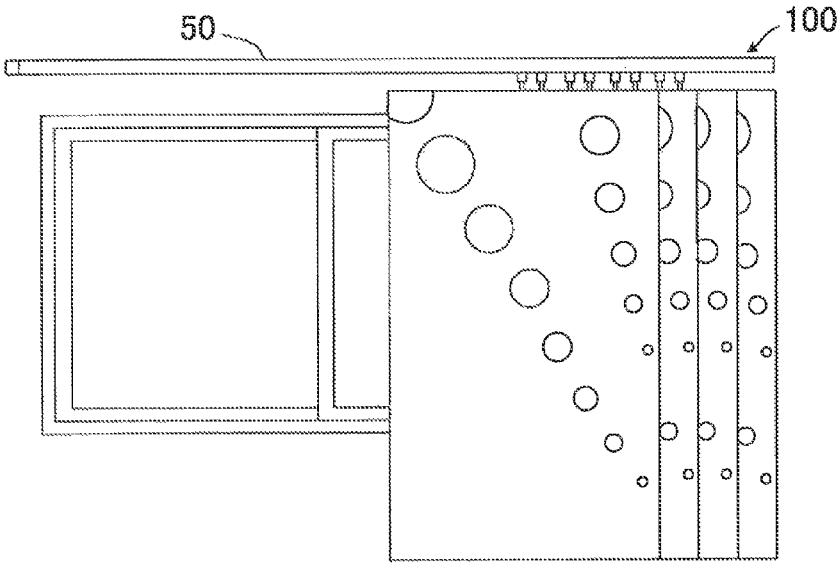

FIGS. 8(*a*) and 8(*b*) are views showing an example of the panel-type curtain where four curtain members are hung on four coupling bars, respectively; on one single curtain rail 50, FIG. 8(*a*) showing the panel-type curtain in an opened state and FIG. 8(*b*) showing the panel-type curtain in a closed state.

Though the preferred embodiment of the present invention has been described above, the present invention is not limited to the embodiment.

For example, as long as the slider can be fitted into the coupling bar by pushing the slider into the coupling bar to turn the same, the shape of the head portion may be a cuboid with a curved face, and some change to the shape of the base portion is also acceptable.

Further, the holding frame 10 of the panel-type curtain 100 includes at least two coupling bars 2 of the first coupling bar 2*a* and the second coupling bar 2*b*, but it is also possible to provide the holding frame 10 with more coupling bars, of course.

In the panel-type curtain 100 according to the embodiment, the touch fastener is attached to the coupling bar, but, for example, anything can be employed in place of the touch fastener as long as it can provide easy attachment of the curtain member.

In the panel-type curtain 100 according to the embodiment, the profile of the support 3 is an S shape, as viewed from a side face thereof, but not limited to it.

Further, two supports 3 are attached to the first coupling bar 2*a* and two supports 3 are attached to the second coupling bar 2*b*, but it is also possible to increase the number of holes 8*a*, 8*b*, 18*a*, 18*b* so that the number of supports to be attached can be increased.

Further, it is preferred that the coupling bar is made of metal, such as aluminum, and the slider is made of synthetic resin, but this is not necessarily a limitation.

As the curtain member 1*a*, 1*b* used in the panel-type curtain 100 according to the embodiment, a known material, such as a sheet of paper, a fabric, or a film, is used properly.

INDUSTRIAL APPLICABILITY

The panel-type curtain 100 according to the present invention is used for screening a room, or partition, separation, or the like of a room. The panel-type curtain 100 according to the present invention can easily be attached to the curtain rail even after the attachment of the curtain member, and sliding of the curtain member can be also made smooth.

DESCRIPTION OF THE REFERENCE NUMERALS

1*a*: First curtain member (curtain member)
1*b*: Second curtain member (curtain member)
2*a*: First coupling bar
2*b*: Second coupling bar
3: Support
3*a*: First rail portion (rail portion)
3*b*: Second rail portion (rail portion)
5*a*: First touch fastener (touch fastener)
5*b*: Second touch fastener (touch fastener)
6: Blocking member
7: Positioning member
8*a*, 8*b*, 18*a*, 18*b*: Hole
10: Holding frame
13*a*: Curved portion
13*a*1: Extended portion
13*b*: Stopper
20: Slider
20*a*: Neck portion
20*b*: Head portion
20*b*1: Elastic tab
20*c*: Base portion
20*c*1: Base
20*c*2: thin portion
50: Curtain rail
51: Runner
100: Panel-type curtain
L1: Length of the short side
L2: Length of the long side
L, L3, L4: Distance
L5: Length of the base portion
N: Screw
P1: Hanging portion
P2: Rising portion

The invention claimed is:

1. A panel-type curtain, comprising:

a curtain rail bar that is elongated in a lateral direction;

runners that are attached to the curtain rail and that are configured to slide along the curtain rail;

a first coupling bar that is elongated in the lateral direction with two lateral end portions, the first coupling bar being hung by one of the runners from the curtain rail and having surface and back sides, wherein a first rail portion is entirely disposed on the surface side having a hollow space extending in the lateral direction, the hollow space being defined by an upper end portion and lower end portion that extend from the surface side, and each upper end portion and lower end portion having a respective distal end, wherein each distal end faces each other forming an opening to the hollow space having an opening distance (L3), both of the lateral end portions thereof are closed so that there is no opening at the lateral end portions and that a middle section through which the hollow space extends is defined between the lateral end portions;

a second coupling bar that is elongated in the lateral direction with two lateral end portions, the second coupling bar being hung by one of the runners from the curtain rail and having surface and back sides, wherein a slider is disposed, comprising a base portion, a neck portion provided to the base portion, and a head portion coupled to the neck portion;

the base portion is fixed on the back side of the second coupling bar and to one of the lateral end portions of the second coupling bar; and the neck portion and the head portion form a T-shaped profile as viewed from the lateral direction, projecting perpendicularly from the back side of the second coupling bar, the head portion has a lateral length (L1) that is defined in the lateral direction, and a width length (L2) that is defined in a width direction that is perpendicular to the lateral direction on the back side of the second coupling bar, the lateral length (L1), width length (L2), and the opening distance (L3) satisfy a formula below:

$L1<L3<L2$;wherein the head portion of the slider is inserted into the hollow space of the first rail portion through the opening in the middle section when the lateral length (L1) of the head portion meets the opening distance (L3) of the hollow space;

the head portion of the slider is engaged with the upper and lower end portions of the first rail portion in the middle section when the width length (L2) of the head portion meets the opening distance (L3) of the hollow space so that the head portion is slidable along the first rail portion in the middle section and not to come out of the first rail portion, and the first and second coupling bars are aligned in a horizontally linear fashion.

2. The panel-type curtain according to claim 1, wherein the runners include supports for hanging the first coupling bar, and the upper and lower end portions of the first coupling bar are provided with holes for the supports so that the runners connect to the first coupling bar.

3. The panel-type curtain according to claim 1, wherein touch fasteners are attached to the back side of the first coupling bar and the back side of the second coupling bar.

4. A coupling method of the panel-type curtain according to claim 1, wherein the second coupling bar is slidably coupled to the first coupling bar by placing the second coupling bar at a right angle to the first coupling bar, then pushing the slider of the second coupling bar into the first rail portion of the first coupling bar, and then turning the second coupling bar by 90 degrees.

5. The panel-type curtain according to claim 1, wherein the base portion of the slider has a distance (L5) in the width direction, and the distances (L3) and (L5) satisfy a formula below:

$L3<L5$.

6. The panel-type curtain according to claim 1, further comprising:

curtain members that are respectively attached on the back sides of the first and second coupling bars.

7. The panel-type curtain according to claim 1, wherein the runners include supports for hanging the second coupling bar; wherein the second coupling bar has upper and lower end portions, and the upper and lower end portions of the second coupling bar are provided with holes for the supports so that the runners connect to the second coupling bar.

8. The panel-type curtain according to claim 1, wherein:

the second coupling bar has a second rail portion that is identical to the first rail portion on the surface side;

the other lateral end portion of the second coupling bar is capped with a blocking member so that both of the lateral end portions of the second coupling bar are closed, defining another middle section of the second coupling bar between the slider and the blocking member, a third coupling bar is further provided, being identical to the second coupling bar, including another slider and blocking member, the another slider of the third coupling bar is engaged with the second rail portion so that the back side of the third coupling bar is connected to the surface side of the second coupling bar with the engagement of the another slider and the second rail portion.

9. The panel-type curtain according to claim 8, wherein the second rail portion of the second coupling bar is identical to the first rail portion of the first coupling bar.

* * * * *